US005408798A

United States Patent [19]

Hohmann

[11] Patent Number: 5,408,798

[45] Date of Patent: Apr. 25, 1995

[54] SEISMIC CONSTRUCTION SYSTEM

[76] Inventor: Ronald P. Hohmann, 32 Stratford Pl., Syosset, N.Y. 11791

[21] Appl. No.: 145,585

[22] Filed: Nov. 4, 1993

[51] Int. Cl.[6] ..... E04B 1/02

[52] U.S. Cl. ..... 52/562; 52/713

[58] Field of Search ..... 52/562, 713, 714, 379, 52/410

[56] References Cited

U.S. PATENT DOCUMENTS 3,300,939 1/1967 Brynjolfsson et al. ..... 52/713

*Primary Examiner*—Carl D. Friedman
*Assistant Examiner*—Creighton Smith
*Attorney, Agent, or Firm*—Siegmar Silber

[57] ABSTRACT

A seismic construction system is disclosed having in combination: a masonry anchor, a wall tie, and a facing anchor. A reinforcing wire is disposed longitudinally in the inner masonry wythe and has attached spaced pairs of transverse wire portions. Each transverse wire portion extends into the cavity and terminates in an eye wire having an eye disposed vertically in the cavity and lying in a plane normal to the masonry wythe surface. The open end of the wall tie is threaded through a pair of eye wires of the masonry anchor, which eye wire portion extends into the cavity between the inner masonry wythe and the outer facing wythe. The masonry anchor is adapted to be embedded within the inner masonry wythe; and, after threading through the eye wires, the open end of the wall tie, within the outer facing wythe. The facing anchor includes a clip member which is constructed to accommodate the open end of the wall tie member and also a reinforcing wire disposed longitudinally in the facing wythe. Upon the closed end of the wall tie being captive in the eye wires of the masonry anchor and the open end of the wall tie and the clip of the facing anchor being embedded in the outer facing wythe, a seismic construct is formed with nominal endplay along the x- and z-axes and limited movement along the y-axis.

37 Claims, 3 Drawing Sheets

158
160
162

148
152
156
154
158
162
160
144
164
166
170
180
186
176
174
172
178
168
188
182
192
184
190

52
56
40
48
54
46
64
44
58
62
66
42
92
90
80
88
70
76
84
82
74
72
68
78
86

60
62
58

SEISMIC CONSTRUCTION SYSTEM

BACKGROUND OF THE INVENTION

1. Field of the Invention

This invention relates to a improved seismic construction system for use in conjunction with wall systems employing an inner wythe and an outer wythe. More particularly, to construction techniques for embedding a continuous wire in the mortar joints of both wythes and having a positive interconnection therebetween.

2. Information Disclosure Statement

In the past, investigations relating to the effects of earthquakes upon building structures demonstrated the advantages of having a continuous wire embedded in the mortar joint of anchored veneer walls. These investigations were referenced in the inventor's prior patent, namely U.S. Pat. No. 4,875,319. The referenced investigations resulted in the incorporation of a requirement for continuous wire reinforcement in the Uniform Building Code provisions covering seismic zone construction. The code requires that this wire is to be secured to the tie anchor which is fastened to the support structure. The use of a continuous wire in masonry veneer walls has been found to have additional benefits in providing protection against problems arising from thermal expansion and contraction and improving the uniformity of the distribution of the lateral forces in a structure.

The following patents are believed to be relevant and are disclosed as being known to the inventor hereof:

| U.S. Pat. No. | Inventor | Issue Date |
|---|---|---|
| 3,377,764 | Storch | 04/16/1968 |
| 3,964,226 | Hala et al. | 06/22/1976 |
| 4,021,990 | Schwalberg | 05/10/1977 |
| 4,869,038 | Catani | 09/26/1989 |
| 4,875,319 | Hohmann | 10/24/1989 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety without positive restriction on escape by vertical displacement.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 3,964,226—A. A. Hala et al.—Issued Jun. 22, 1976

Discloses a bent wire, pintie-type anchor for embedment in a facing exterior wythe engaging with an eyelet or bar attached to straight wire runs in a backup interior wythe. The pintle is attached to a straight wire run for embedment in the facing exterior wythe.

U.S. Pat. No. 4,021,990—B. J. Schwalberg—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,869,038—M. J. Catani—Issued Sep. 26 ,1989

Discloses a veneer wall anchor system having in the interior wythe a truss-type anchor, similar to Hala et al. '226, supra, but with horizontal sheetmetal extensions. The extensions are interlocked with bent wire pintie-type wall ties that are embedded within the exterior wythe.

U.S. Pat. No. 4,879,319—R. Hobmann—Issued Oct. 24, 1989

Discloses a seismic constructuion system for anchoring a facing veneer to wallboard/metal stud construction with a pronged sheetmetal anchor. Wall tie is distinguished over that of Schwalberg '990 and is clipped onto a straight wire run.

None of the above provide the seismic construction system for an inner masonry wythe and an outer facing wythe having a positive interconnection as described hereinbelow.

SUMMARY

In general terms, the invention disclosed hereby includes a seismic construction system for use in the construction of wall structures having an inner masonry wythe and an outer facing wythe. The wythes are in a spaced apart relationship and form a cavity therebetween. In the disclosed system, a unique combination of a masonry anchor, a wall tie member, and a facing anchor is provided. The invention contemplates that the primary components of the system are reinforcing wire and wire-to-wire connections thereof.

In the best mode of practicing the invention, the masonry anchor has a truss portion with eye wire extensions welded thereto. The eye wires extend into the cavity between the wythes and accommodate the threading there into of one end of the wire wall ties. The masonry anchor is embdedded in a bed joint of the interior wythe. The facing anchor has a straight wire run and seismic clips mounted therealong to receive the other end of wire wall tie. The facing anchor is embedded in a bed joint of the exterior wythe. Because the eye wires have sealed eyelets or loops and the open ends of the wall ties are sealed in the joints of the exterior wythes, a positive interengagement results.

OBJECT AND FEATURES OF THE INVENTION

It is an object of the present invention to provide in a wall structure having a facing brick wythe and a masonry block backup wythe, a seismic construction system which incorporates continuous wire reinforcements in the mortar joint of both the brick facing wythe and in the corresponding mortar joint of the backup block wythe.

It is another object of the present invention to provide labor-saving devices to aid in the installation of brick and stone veneer and the securement thereof to masonry block.

It is yet another object of the present invention to provide a seismic construction system which ties together the continuous wire reinforcement in a positive manner such that the connective portion in the cavity between the wythes cannot separate.

It is a further object of the present invention to provide a seismic construction system which comprises a limited number of component parts which are economical of manufacture resulting in a relatively low unit cost.

It is yet another object of the present invention to provide a reinforcement device which will restrict in and out movement of the facing brick or veneer with respect to the masonry block, but is adjustable horizontally and optionally vertically.

It is a feature of the present invention that the loop portion of the device hereof secures a rectangular tie which, in turn, inserts into a seismic clip.

It is another feature of the present invention that the loop portion of the device hereof secures a rectangular tie, the loop portion of which is secured to a continuous web—either ladder or truss—of pencil rod reinforcements.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENT

Figure 1:
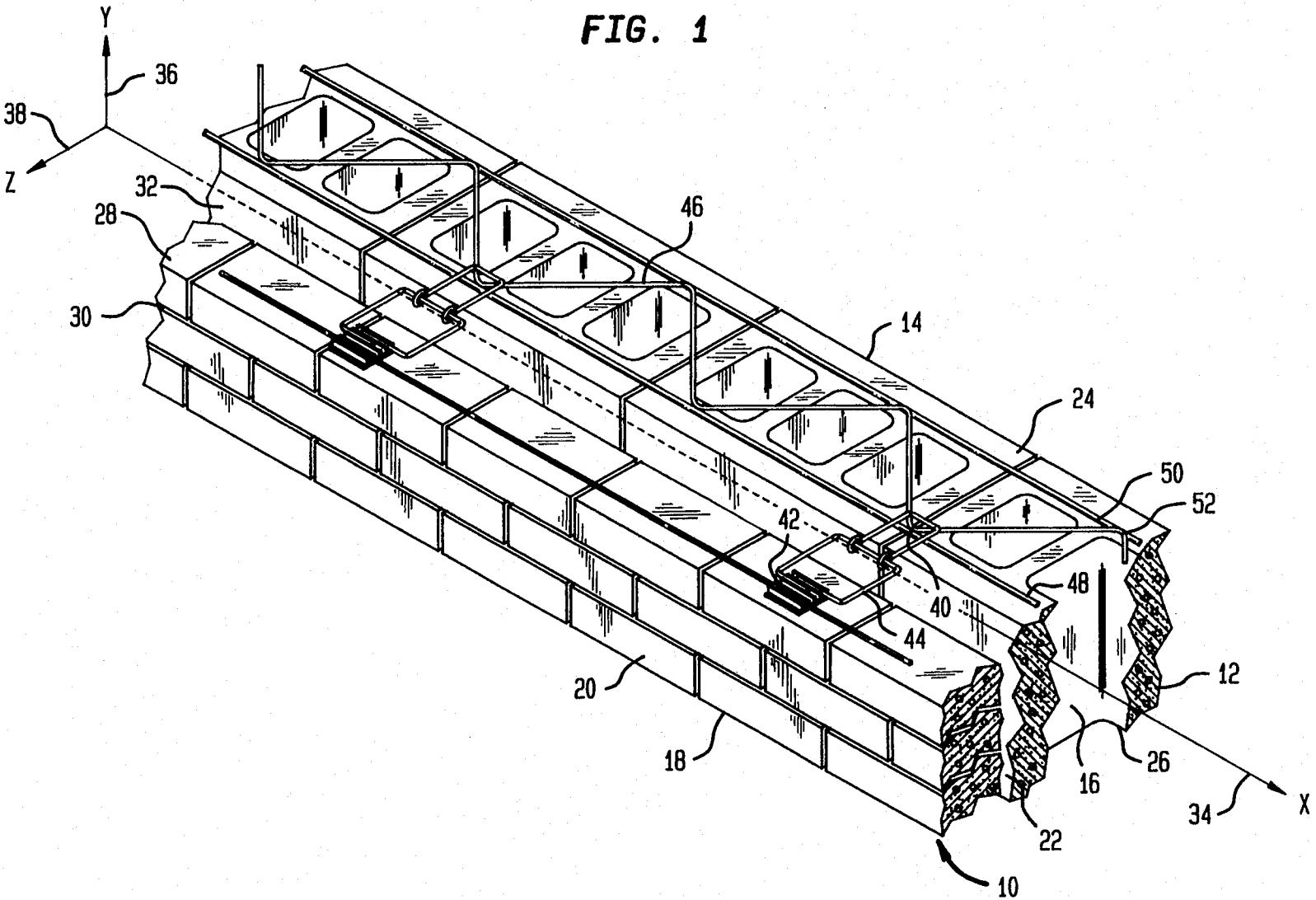
FIG. 1 is a perspective view of a first embodiment of a seismic construction system for wall structures of this invention and is shown in relation to a wall with an interior wythe of masonry block and an exterior wythe of facing brick, each having selected bed joints in alignment with one another.
Figures 2, 3, 5, 6:
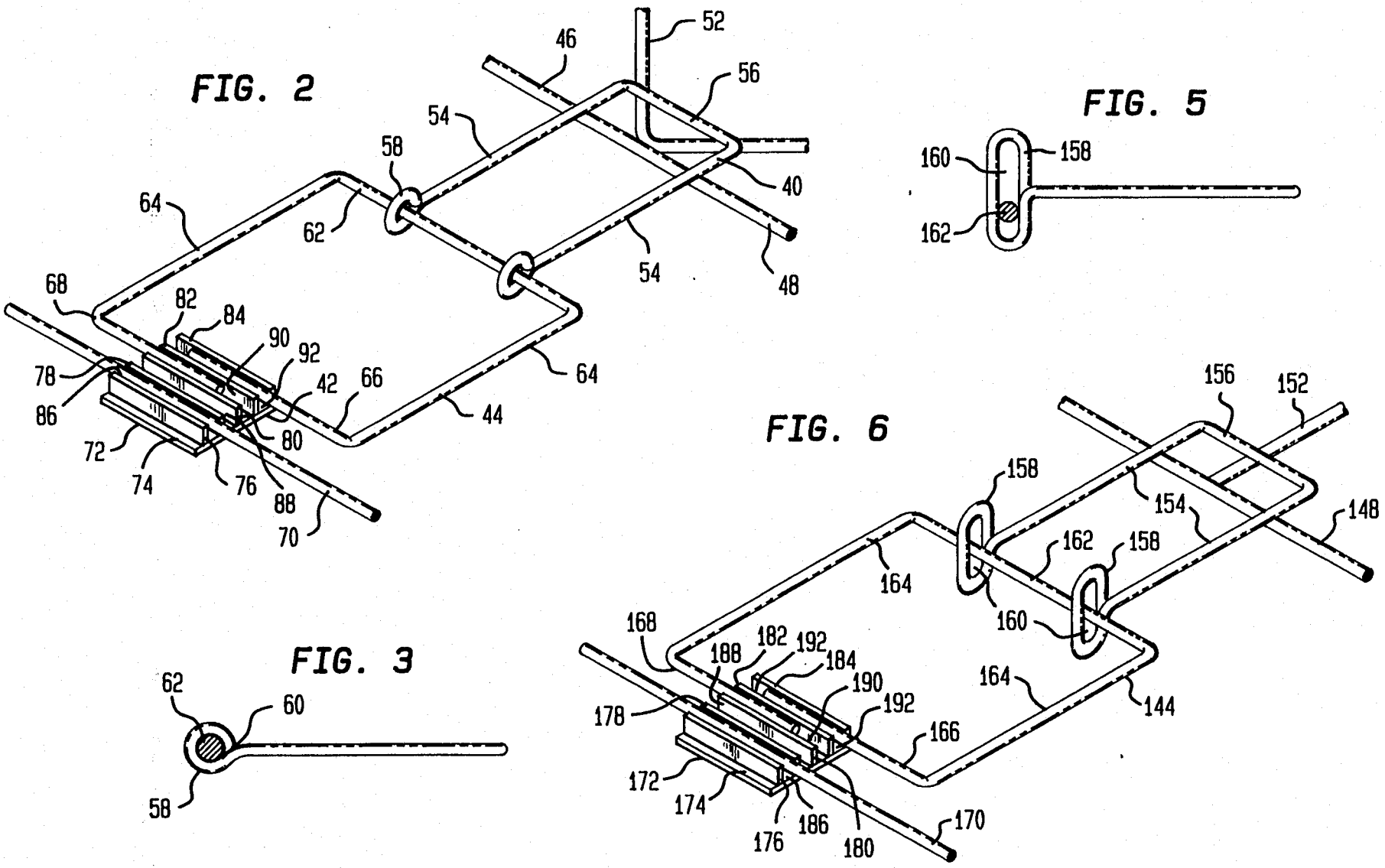
FIG. 2 is a partial perspective view of the invention of FIG. 1 and shows in greater detail the masonry anchor with the eye wire portion thereof, the facing anchor with the exterior clip member, and the interconnecting wall tie member.
FIG. 3 a side elevational view of the vertical eye of the eye wire portion of FIG. 2.
FIG. 5 is a partial perspective view of the invention of FIG. 4 and shows in greater detail the masonry anchor with the eye wire portion thereof, the facing anchor with the exterior clip member, and the interconnecting wall tie member; and, FIG. 6 is a side elevational view of the vertical eye of the eye wire portion of FIG. 5.

Referring now to FIGS. 1 to 3, the first embodiment of a seismic construction system of this invention is shown and is referred to generally by the numeral 10. In this embodiment, a wall structure 12 is shown having an interior wythe 14 of masonry blocks 16 and an exterior wythe 18 of facing brick 20. The interior wythe 14 of masonry blocks 16 is also referred to herein as an inner masonry wythe and, similarly the exterior wythe 18 of facing brick 20 is also referred to herein as an outer facing wythe. The Between the interior wythe 14 and the exterior wythe 18, a cavity 22 is formed. In the first embodiment, successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. Selected bed joint 24 and bed joint 28 are constructed to align, that is to be substantially coplanar, the one with the other. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the y-axis. The system 10 includes a masonry anchor 40 constructed for embedment in bed joint 24, a facing anchor 42 constructed for embedment in bed joint 28 and an interconnecting wall tie number 44.

The masonry anchor 40 is shown in FIG. 1 as being emplaced on a course of blocks 16 in preparation for embedment in the mortar of bed joint 24. In the best mode of practicing the invention, a truss or reinforcement wire portion or first reinforcement wire portion 46 is constructed of a wire formative with two parallel continuous straight wire members 48 and 50 spaced so as, upon installation, to each be centered along the outer walls of the masonry blocks 16. An intermediate wire body or wire 52 is interposed therebetween and connects wire members 48 and 50 forming chord-like portions of the truss 46. At intervals along the truss 46, spaced pairs of transverse wire members 54 are attached thereto and are attached to each other by a rear leg 56 therebetween. These pairs of wire members 54 extend into the cavity 22. Inasmuch as the reinforcement portion 46 are emplaced in a direction along the wythe in an x-axis direction and are considered longitudinal, the wire members 54 of the masonryanchor 40 are in a direction across the wythe in a z-axis direction and are considered transverse. As will become clear by the description which follows, the spacing therebetween is constructed to limit the x-axis movement of the construct. Each transverse wire member 54 has at the end opposite the attachment end an eye wire portion 58 formed continuous therewith. A sheetmetal loop is an alternative construction in lieu of eye wires shown in the best mode; however, the wire formative has been found to be structurally superior. Upon installation, the eye 60 of eye wire portion 58 is constructed to be within a substantially vertical plane normal to exterior surface 32. The eye 60 is dimensioned to accept a wire tie therethrough and is thus slightly larger than the diameter of the tie. This relationship minimizes the y- and z-axis movement of the construct. For positive engagement, the eye 60 of eye wire portion 58 is sealed forming a closed loop.

The wall tie 44 is generally rectangular in shape and is dimensioned to be accommodated by a pair of eye wires 58 previously described. The wall tie 44 has a rear leg portion 62, two parallel side leg portions 64, and a base portion formed from two parallel front leg portions 66 and 68. To facilitate installation, the front leg portions 66 and 68 are spaced apart by the diameter of the wire member 54. The longitudinal axes of leg portions 62, 64, 66 and 68 are substantially coplanar. The side leg portions 64 are structured to function cooperatively with the spacing of transverse wire members 54 to limit the x-axis movement of the construct.

The facing anchor 42 is constructed from a straight wire member 70 and a clip member 72. The clip member 72 is an adaptation of the clip member described in U.S. Pat. 4,875,319, supra, and, like the predecessor, is of unitary construction. The clip member 72 includes a base portion 74 and a plurality of substantially parallel projections 76, 78, 80, 82 and 84 defining a plurality of channels 86, 88, 90, and 92. The spacing between projections is proportioned in a manner such that the two innermost channels accept the front leg portions 66 and 68 of the wall tie 44. The spacing forming the two outermost channels are dimensioned such that one or more wire members 70 of preselected diameters may be selectively inserted in the appropriate channel. The bottom portion 94 of the clip member 72 has a plurality of parallel grooves 96. These grooves facilitate the bonding of the clip member 72 to the mortar in the bed joints upon bricks 20. During the construction of the exterior wythe 18, the mortar also fills the channels of clip member 72 thereby bonding together the clip, the reinforcing wire and the wall tie member.

Figure 4:
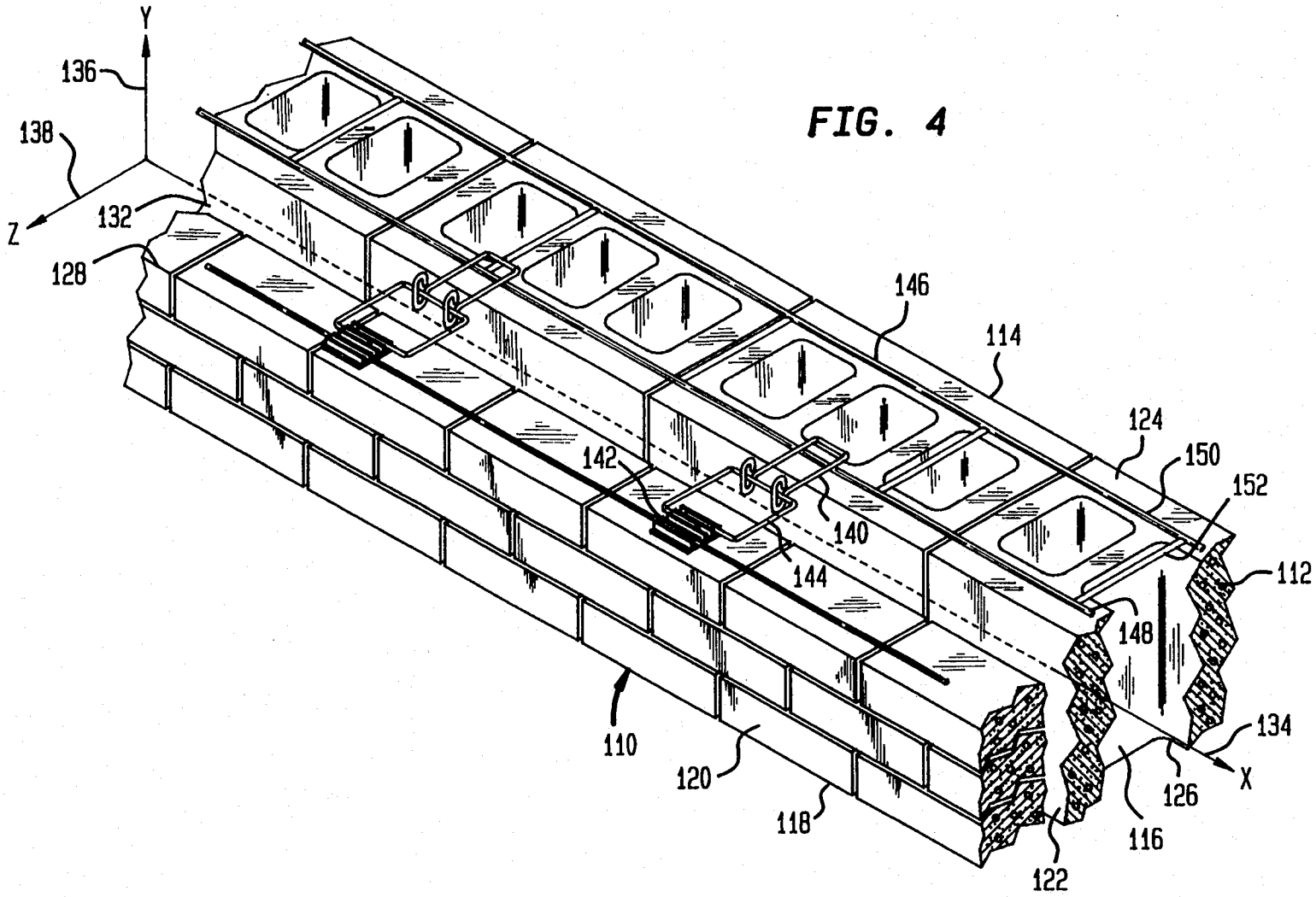
FIG. 4 is a perspective view of a second embodiment of a seismic construction system for wall structures of this invention and is shown in relation to a wall with an interior wythe of masonry block and an exterior wythe of facing brick, each having selected bed joints not in alignment with one another.

The description which follows is of a second embodiment of the seismic construction system. For ease of comprehension, where similar parts are used reference designators "100" units higher are employed. Thus, the clip member 172 of the second embodiment is analogous to the clip member 72 of the first embodiment. Referring now to FIGS. 4 to 6, the second embodiment of a seismic construction system of this invention is shown and is referred to generally by the numeral 110. As in the first embodiment, a wall structure 112 is shown having an interior wythe 114 of masonry blocks 116 and an exterior wythe 118 of facing brick 120. Between the interior wythe 114 and the exterior wythe 118, a cavity 122 is formed. Successive bed joints 124 and 126 are formed between courses of blocks 116 and the joints are substantially planar and horizontally disposed. Also, successive bed joints 128 and 130 are formed between courses of bricks 120 and the joints are substantially planar and horizontally disposed. Selected bed joint 124 and bed joint 128 are constructed to align, that is to be substantially coplanar, the one with the other. For purposes of discussion, the exterior surface 132 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a masonry anchor 140 constructed for embedment in bed joint 124, a facing anchor 142 constructed for embedment in bed joint 128 and an interconnecting wall tie number 144.

The masonry anchor 140 is shown in FIG. 4 as being emplaced on a course of blocks 116 in preparation for embedment in the mortar of bed joint 124. In the best mode, a ladder- or truss-type reinforcement wire portion 146 is constructed of a wire formative with two parallel continuous straight wire members 148 and 150 spaced so as, upon installation, to each be centered along the outer walls of the masonry blocks 116. An intermediate wire body or a plurality of wires 152 are interposed therebetween and connects wire members 148 and 150 forming chord-like portions of the truss 146. At intervals along the truss 146, spaced pairs of transverse wire members 154 are attached thereto and are attached to each other by a rear leg 156 therebetween. These pairs of wire members 154 extend into the cavity 122. The spacing therebetween is constructed to limit the x-axis movement of the construct. Each transverse wire member 154 has at the end opposite the attachment end an eye wire portion 158 formed continuous therewith. Upon installation, the eye 160 of eye wire portion 158 is constructed to be within a substantially vertical plane normal to exterior surface 132. The eye 160 is elongated vertically in both directions to accept a wire tie therethrough from an unaligned bed joint and is slightly larger horizontally than the diameter of the tie. This dimensional relationship minimizes the z-axis movement of the construct. For positive engagement, the eye 160 of eye wire portion 158 is sealed forming a closed loop.

The wall tie 144 is generally rectangular in shape and is dimensioned to be accommodated by a pair of eye wires 158 previously described. When rectangular, the wall tie 144 has a rear leg portion 162, two parallel side leg portions 164, and two parallel front leg portions 166 and 168. To facilitate installation, the front leg portions 166 and 168 are spaced apart by the diameter of the wire member 154. The longitudinal axes of leg portions 162, 164,166 and 168 are substantially coplanar. The side leg portions 164 are structured to function cooperatively with the spacing of transverse wire members 154 to limit the x-axis movement of the construct.

The facing anchor 142 is constructed from a straight wire member 170 and a clip member 172. The clip member 172 is an adaptation of the clip member described in U.S. Pat. No. 4,875,319, supra, and, like the predecessor, is of unitary construction. The clip member 172 includes a base portion 174 and a plurality of substantially parallel projections 176, 178, 180, 182 and 184 defining a plurality of channels 186, 188, 190, and 192. The spacing between projections is proportioned in a manner such that the two innermost channels accept the front leg portions 166 and 168 of the wall tie 144. The spacing forming the two outermost channels are dimensioned such that straight wire member 170 of two preselected diameters may be selectively inserted in the appropriate channel. The bottom portion 194 of the clip member 172 has a plurality of parallel grooves 196. These grooves facilitate the bonding of the clip member 172 to the mortar in the bed joints upon bricks 120. During the construction of the exterior wythe 118, the mortar also fills the channels of clip member 172 thereby bonding together the clip, the reinforcing wire and the wall tie member.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A seismic construction system for use in the construction of wall structures having an inner masonry wythe and an outer facing wythe in spaced apart relationship forming a cavity therebetween, said system comprising, in combination:

a masonry anchor adapted to be embedded within said inner masonry wythe, in turn comprising:

a first reinforcement wire portion disposed longitudinally therein;

spaced pairs of transverse wire portions extending therefrom, each transverse wire portion attached at one end thereof to said first reinforcement wire portion and, when embedded in said inner masonry wythe, extending into said cavity and terminating therewithin;

an eye wire portion formed continuous with each said transverse wire portion and attached thereto at the end opposite the attachment end, said eye wire portion forming an eye adapted, when installed in said wall structure, to be disposed vertically in said cavity lying in a plane normal to the masonry wythe surface;

a wall tie member having a first end portion and a second end portion, said first end portion being captively disposed in one pair of said eye wire portions; and, a facing anchor adapted to be embedded within said outer facing wythe, said facing anchor, in turn, comprising:

a clip member comprising having a base member, said base member including:

first and second attachment means formed thereon, said second end portion of said wall tie member being secured to said first attachment means of said clip member;

at least one second reinforcement wire portion disposed longitudinally in said facing wythe and secured to said second attachment means of said clip member;

whereby upon embedment of said masonry anchor in said inner masonry wythe, the captive disposition of the wall tie member in the eye wire portion thereof, and the embedment of said facing anchor with the second end portion of the wall tie member secured thereto in said outer facing wythe; a seismic construct is formed.

2. A seismic construction system as described in claim 1 wherein said masonry wythe is constructed of blocks resting upon a substantial planar bed joint with successive layers thereof having bed joints substantially parallel thereto.

3. A seismic construction system as described in claim 2 wherein said facing wythe is constructed of bricks resting upon a bed joint with successive layers thereof having bed joints substantially parallel thereto, and wherein selected ones of said bed joints are substantially coplanar with selected bed joints of said masonry wythe.

4. A seismic construction system as described in claim 3 wherein said wall tie member is formed from a wire stock and said eye is dimensioned to receive therewithin said wire stock with minimal axial endplay.

5. A seismic construction system as described in claim 4 wherein a horizontal line within the surface plane of the masonry wythe defines the x-axis, an intersecting vertical line within the surface plane of the masonry wythe defines the y-axis, and a line normal thereto and passing through the intersection defines the z-axis, said wall structure has substantially no y-axis and substantially no z-axis movement of the inner wythe with respect to the outer wythe.

6. A seismic construction system as described in claim 4 wherein said eye wire portion is sealed by affixing the end thereof opposite the end attached to the transverse wire portion to a medial part of the eye wire portion and thereby forming a closed loop.

7. A seismic construction system as described in claim 1 wherein said first reinforcement wire portion is a single reinforcing wire.

8. A seismic construction system as described in claim 1 wherein said first reinforcement wire portion is a reinforcing wire truss.

9. A seismic construction system as described in claim 8 wherein said reinforcing wire truss further comprises:

a pair of reinforcement wires disposed parallel the one to the other, both of which are adapted to be embedded within said bed joint of said masonry wythe;

a plurality of wire chords each attached to both said reinforcement wires in a predetermined array.

10. A seismic construction system as described in claim 1 wherein:

said clip member comprises a plurality of spaced apart projections projecting from said base member;

said projections are disposed in spaced apart parallel relationship with respect to one another thereby forming a plurality of parallel channels therebetween which form said first and second attachment means.

11. A seismic construction system as described in claim 10 wherein:

a pair of adjacent selected channels are proportioned to accept said second end portion of said wall tie member.

12. A seismic construction system as described in claim 1 wherein said wall tie member further comprises:

a rear leg portion;

a pair of leg portions attached thereto and coplanar therewith, said leg portions projecting toward said rear leg portion;

a base portion attached to and coplanar with said leg portions, said base portion having a pair of spaced apart members, said spaced apart members disposed in substantially parallel relationship the one to the other.

13. A seismic construction system as described in claim 12, wherein:

said clip member comprises a plurality of spaced apart parallel projections projecting from said base member thereby forming a plurality of parallel channels between said projections;

a first one of said spaced apart members of said base portion being disposed in a first one of said parallel channels; and, a second one of said spaced apart members of said base portion being disposed in a second one of said parallel channels.

14. A seismic construction system as described in claim 13, wherein:

said first and second parallel channels are disposed in adjacent proximate relationship.

15. A seismic construction system described in claim 2 wherein said facing wythe is constructed of bricks resting upon a bed joint with successive layers thereof having bed joints substantially parallel thereto, and wherein said bed joints are unaligned with said bed joints of said masonry wythe.

16. A seismic construction system described in claim 15 wherein said eyes, when installed in said wall structure, are vertically elongated with a horizontal opening therethrough dimensioned to receive therewithin said wall tie member with minimal interfacial endplay.

17. A seismic construction system as described in claim 16 wherein a horizontal line within the surface plane of the masonry wythe defines the x-axis, an intersecting vertical line within the surface plane of the masonry wythe defines the y-axis, and a line normal thereto and passing through the intersection defines the z-axis, said wall structure has substantially no z-axis movement of the inner wythe with respect to the outer wythe.

18. A seismic construction system as described in claim 17 within said eye wire portion is sealed by adhering the end thereof opposite the end attached to the transverse wire portion to a medial part of the eye wire portion thereby forming a closed loop.

19. A seismic construction system as described in claim 15 wherein:

said clip member comprises a plurality of spaced apart projections projecting from said base member;

said projections are disposed in spaced apart parallel relationship with respect to one another thereby forming a plurality of parallel channels therebetween which form said first and second attachment means.

20. A seismic construction system as described in claim 19 wherein:

a pair of adjacent selected channels are proportioned to accept said second end portion of said wall tie member.

21. A seismic construction system as described in claim 15 wherein said wall tie member further comprises:

a rear leg portion;

a pair of leg portions attached thereto and coplanar therewith, said leg portions projecting toward said rear leg portion;

a base portion attached to and coplanar with said leg portions, said base portion having a pair of spaced apart members, said spaced apart members disposed in substantially parallel relationship the one to the other.

22. A seismic construction system as described in claim 21, wherein:

said clip member comprises a plurality of spaced apart parallel projections projecting from said base member thereby forming a plurality of parallel channels between said projections;

a first one of said spaced apart members of said base portion being disposed in a first one of said parallel channels; and, a second one of said spaced apart members of said base portion being disposed in a second one of said parallel channels.

23. A seismic construction system as described in claim 22, wherein said first and second parallel channels are disposed in adjacent proximate relationship.

24. A seismic construction system for use in the construction of wall structures having an inner wythe of block masonry and an outer wythe of facing brick, said inner wythe and said outer wythe in spaced apart relationship forming a cavity therebetween, said system comprising, in combination:

a masonry anchor adapted to be embedded within said inner wythe of masonry block, in turn comprising:

a reinforcing wire truss having a pair of reinforcement wires disposed parallel the one to the other;

a plurality of wire chords each attached to both said reinforcement wires in a predetermined configuration;

pairs of transverse wire portions spaced along and extending from said reinforcing wire truss, each transverse wire portion attached at one end thereof to said reinforcing wire truss and, when embedded in said inner wythe, extending into said cavity and terminating therewithin;

an eye wire portion formed continuous with each said transverse wire portion and attached thereto at the end opposite the attachment end, said eye wire portion forming an eye adapted, when installed in said wall structure, to be disposed vertically in said cavity lying in a plane normal to the masonry wythe surface;

a wall tie member having a first end portion and a second end portion, said first end portion being captively disposed in one pair of said eye wire portions; and, a facing anchor adapted to be embedded within said outer facing wythe, said facing anchor, in turn, comprising:

a clip member comprising having a base member, said base member including:

first and second attachment means formed thereon, said second end portion of said wall tie member being secured to said first attachment means of said clip member;

a reinforcement wire portion disposed longitudinally in said facing wythe and secured to said second attachment means of said clip member;

whereby upon embedment of said masonry anchor in said inner masonry wythe, the captive disposition of the wall tie member in the eye wire portion thereof, and the embedment of said facing anchor with the second end portion of the wall tie member secured thereto in said outer facing wythe; a seismic construct is formed.

25. A seismic construction system as described in claim 24 wherein said facing wythe is constructed of bricks resting upon a bed joint with successive layers thereof having bed joints substantially parallel thereto, and wherein selected ones of said bed joints are substantially coplanar with selected bed joints of said masonry wythe.

26. A seismic construction system as described in claim 25 wherein said wall tie member is formed from a wire stock and said eye is dimensioned to receive therewithin said were stock with minimal axial endplay.

27. A seismic construction system as described in claim 26 wherein a horizontal line within the surface plane of the masonry wythe defines the x-axis, an intersecting vertical line within the surface plane of the masonry wythe defines the y-axis, and a line normal thereto and passing through the intersection defines the z-axis, said wall structure has substantially no y-axis and substantially no z-axis movement of the inner wythe with respect to the outer wythe.

28. A seismic construction system as described in claim 26 wherein said eye wire portion is sealed by affixing the end thereof opposite the end attached to the transverse wire portion to a medial part of the eye wire portion and thereby forming a closed loop.

29. A seismic construction system as described in claim 24 wherein:

said clip member comprises a plurality of spaced apart projections projecting from said base member;

said projections are disposed in spaced apart parallel relationship with respect to one another thereby forming a plurality of parallel channels therebetween which form said first and second attachment means.

30. A seismic construction system as described in claim 29 wherein:

a pair of adjacent selected channels are proportioned to accept said second end portion of said wall tie member.

31. A seismic construction system as described in claim 30 wherein said wall tie member further comprises:

a rear leg portion;

a pair of leg portions attached thereto and coplanar therewith, said projecting toward said rear leg portion;

a base portion attached to and coplanar with said leg portions, said base portion having a pair of spaced apart members, said spaced apart members disposed in substantially parallel relationship the one to the other.

32. A seismic construction system as described in claim 30, wherein:

said clip member comprises a plurality of spaced apart parallel projections projecting from said base member thereby forming a plurality of parallel channels between said projections;

a first one of said spaced apart members of said base portion being disposed in a first one of said parallel channels; and, a second one of said spaced apart members of said base portion being disposed in a second one of said parallel channels.

33. A seismic construction system as described in claim 24 wherein:

said clip member comprises a plurality of spaced apart projections projecting from said base member; p1 said projections are disposed in spaced apart parallel relationship with respect to one another thereby forming a plurality of parallel channels therebetween which form said first and second attachment means.

34. A seismic construction system as described in claim 33 wherein:

a pair of adjacent selected channels are proportioned to accept said second end portion of said wall tie member.

35. A seismic construction system as described in claim 24 wherein said wall tie member further comprises:

a rear leg portion;

a pair of leg portions attached thereto and coplanar therewith, said leg portions projecting toward said rear leg portion;

a base portion attached to and coplanar with said leg portion, said base portion having a pair of spaced apart members, said spaced apart members disposed in substantially parallel relationship the one to the other.

36. A seismic construction system as described in claim 35, wherein:

said clip member comprises a plurality of spaced apart parallel projections projecting from said base member thereby forming a plurality of parallel channels between said projections;

a first one of said spaced apart members of said base portion being disposed in a first one of said parallel channels; and, a second one of said spaced apart members of said base portion being disposed in a second one of said parallel channels.

37. A seismic construction system as described in claim 36, wherein said first and second parallel channels are disposed in adjacent proximate relationship.

* * * * *